US006405870B1

(12) United States Patent
Lahti et al.

(10) Patent No.: US 6,405,870 B1
(45) Date of Patent: Jun. 18, 2002

(54) TIP KIT

(75) Inventors: Arto Lahti, Kerava; Klaus Löytäinen, Helsinki; Ari Karttunen, Vantaa, all of (FI)

(73) Assignee: Thermo Labsystems Oy, Helsinki (FI)

( * ) Notice: Subject to any disclaimer, the term of this patent is extended or adjusted under 35 U.S.C. 154(b) by 0 days.

(21) Appl. No.: 09/634,655

(22) Filed: Aug. 8, 2000

(30) Foreign Application Priority Data

Aug. 9, 1999 (FI) ..... 19991688

(51) Int. Cl.[7] ..... B65D 85/62
(52) U.S. Cl. ..... 206/499; 422/100
(58) Field of Search ..... 206/499, 585; 422/100; 221/93, 221; 414/404, 414

(56) References Cited

U.S. PATENT DOCUMENTS 5,111,965 A 5/1992 Allen et al.
5,228,569 A * 7/1993 House ..... 206/372
5,441,702 A * 8/1995 Lemieux et al. ..... 422/100
5,568,881 A 10/1996 Chi
5,588,782 A 12/1996 Tiso
5,612,000 A 3/1997 Lemieux
5,948,362 A * 9/1999 Steinbrenner et al. ..... 422/100
6,079,593 A * 6/2000 Konrad ..... 221/299
6,164,449 A * 12/2000 Lahti ..... 206/499

FOREIGN PATENT DOCUMENTS

EP WO 95/08392 3/1995
GB 2 241 223 * 8/1991
WO WO 95/33563 12/1995

* cited by examiner

*Primary Examiner*—David T. Fidei
(74) *Attorney, Agent, or Firm*—Oblon, Spivak, McClelland, Maier & Neustadt, P.C.

(57) ABSTRACT

A pipette tip kit is for storing and dispensing a plurality of pipette tips. The pipette tips are conical in shape and are capable of being nested so as to be arranged in either one column or a plurality of rows of columns. The pipette tip kit has a paper including a surface with a layer of adhesive thereon for supporting a lateral surface of all of the plurality of pipette tips.

15 Claims, 7 Drawing Sheets

Fig. 1
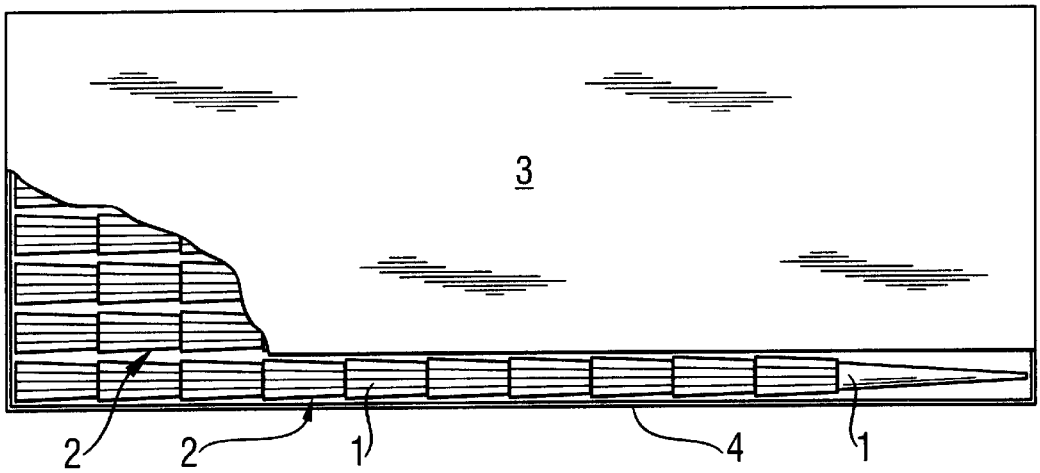
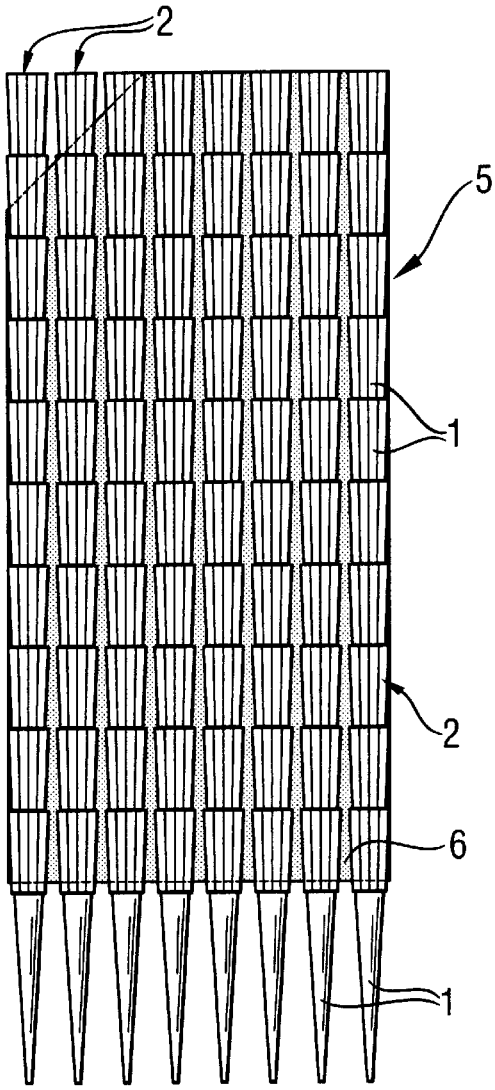
Fig. 2
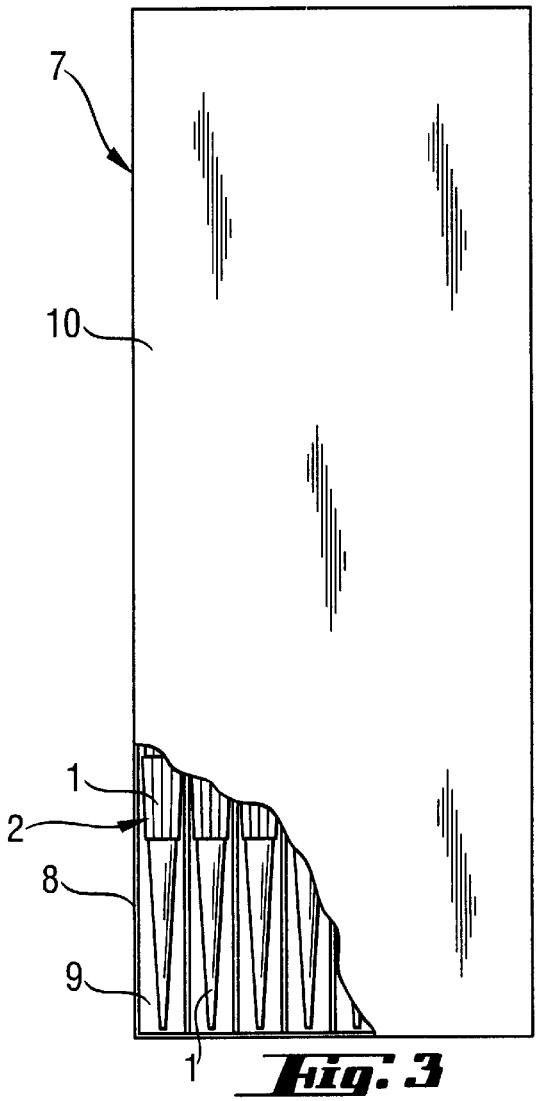
Fig. 3

TIP KIT

FIELD OF TECHNOLOGY

The invention relates to liquid dispensing techniques and concerns a kit of pipette tip containers. The invention is useful both in the manufacture and the storage of tips and in their use.

TECHNOLOGICAL BACKGROUND

Separate tip containers or tips are used in pipettes into which tips liquid to be dispensed is sucked. The tips can be manually attached to the pipette. However, tip racks are also used, in which the tips are vertically positioned and from which the tip is taken into the pipette by pushing the pipette end into the tip. This operation can be performed with only one hand, and no manual contact with the tips is necessary in the attachment step. For a multi-channel pipette, the tips are placed in the rack in an order corresponding to the pipette tip distribution. This also speeds up the attachment of the tips appreciably, as all the tips are inserted into the pipette with one single movement.

During manufacture, the tips can be packaged into separate bags. Such tips can be attached to the pipette by hand, or first stacked in the rack.

The manufacturer can also package the tips directly in racks. They are then easy to take into use. As drawbacks, this entails disposable packaging material in abundance and requires relatively large space during storage and transport.

Patent Application Publication WO 95/08392 discloses a refill kit used together with a tip rack and comprising nested tips in several layers supported by a perforated plate. The perforations are flexible, allowing the tips to be pressed through the plate. The refill kit is placed on the rack to be filled, and the tip layer is pressed through the perforated plate into the rack located below. In the application illustrated in FIG. 7, the uppermost layers are directly supported by the lower layers. Refill kits similar to those shown in FIG. 11 of the publication above, with additional separate support plates provided between the tip layers, have been available on the market.

GENERAL DESCRIPTION OF THE INVENTION

A pipette tip kit as defined in claim 1 has now been invented. The remaining claims define a number of preferred embodiments of the invention.

The tip kit comprises a plurality of nested conical tips and a support surface in lateral contact with all the tips in the row of tips thus formed. The support surface may be e.g. a plane, a groove, such as a groove protected with a cover, or a second row of tips. The kit is used for storing the tips.

The kit may comprise several columns of tips, especially several columns in a row. There may especially be columns of tips with the same distribution as the channel distribution of a multi-channel pipette to be used.

In order to remove the columns of tips from the tip kit, the column may move on the support surface in the longitudinal or the transverse direction of the column.

The column of tips can also be removably attached to the support surface by means of glue, such as adhesive glue.

Adhesive paper can thus be used as the support surface. The support surface may comprise strips which can be torn off strip by strip. The strips may be especially transversal to the direction of the columns of tips, and preferably so that tearing off one strip releases one or one row of tips. The surface be also be such as to be removed by rolling.

The tip kit may also be a dispenser comprising means for removing the tips from the top or the bottom of the column of tips.

In one embodiment, tips can be taken from the tip kit directly into a pipette. In a second embodiment, the tips are transferred from the tip kit into a tip rack. A separate storage tip kit can also be used, from where the tips are transferred into a dispensing tip kit and from there to a tip rack or a pipette.

The main advantage of the invention is that it requires packaging material only in a small amount, but the tips can still be inserted into the pipette without touching them with hands. The invention has the additional advantage of storage and transport packages with relatively small volume.

In one embodiment the tip kit comprises a locking means, with which the column of tips can be retained in the tip kit and detached from it when desired. The locking means can be e.g. an adhesive tape, an elastic hindrance or a movable, such as a rotating barrier.

In one embodiment, the column of tips is removably attached to a paper with glue. The tips can be removed from the paper one by one from the bottom or the top of the column. Such a tip kit can also serve as a storage package used as a dispensing tip kit together with a separate dispenser. The paper may consist of successive strips in the direction of the column of tips, the strips being readily torn off one by one to release the tips. The paper can be used together with a separate dispenser, which may comprise a means for cutting or tearing off a paper strip.

In one embodiment, the tip kit comprises a locking means allowing a tip to be released from the column by pressing the column of tips, especially downwards, against this locking means. The kit may be equipped with a separate actuator for pressing the tips to provide easier dispensing.

Drawings

The accompanying drawings pertain to the written description of the invention and exemplify a number of embodiments of the invention.

FIG. 1 shows a tip kit.

FIG. 2 shows a second tip kit, which may also serve as a tip rack.

FIG. 3 shows a third tip kit.

DETAILED DESCRIPTION OF SOME EMBODIMENTS OF THE INVENTION

Figure 4:
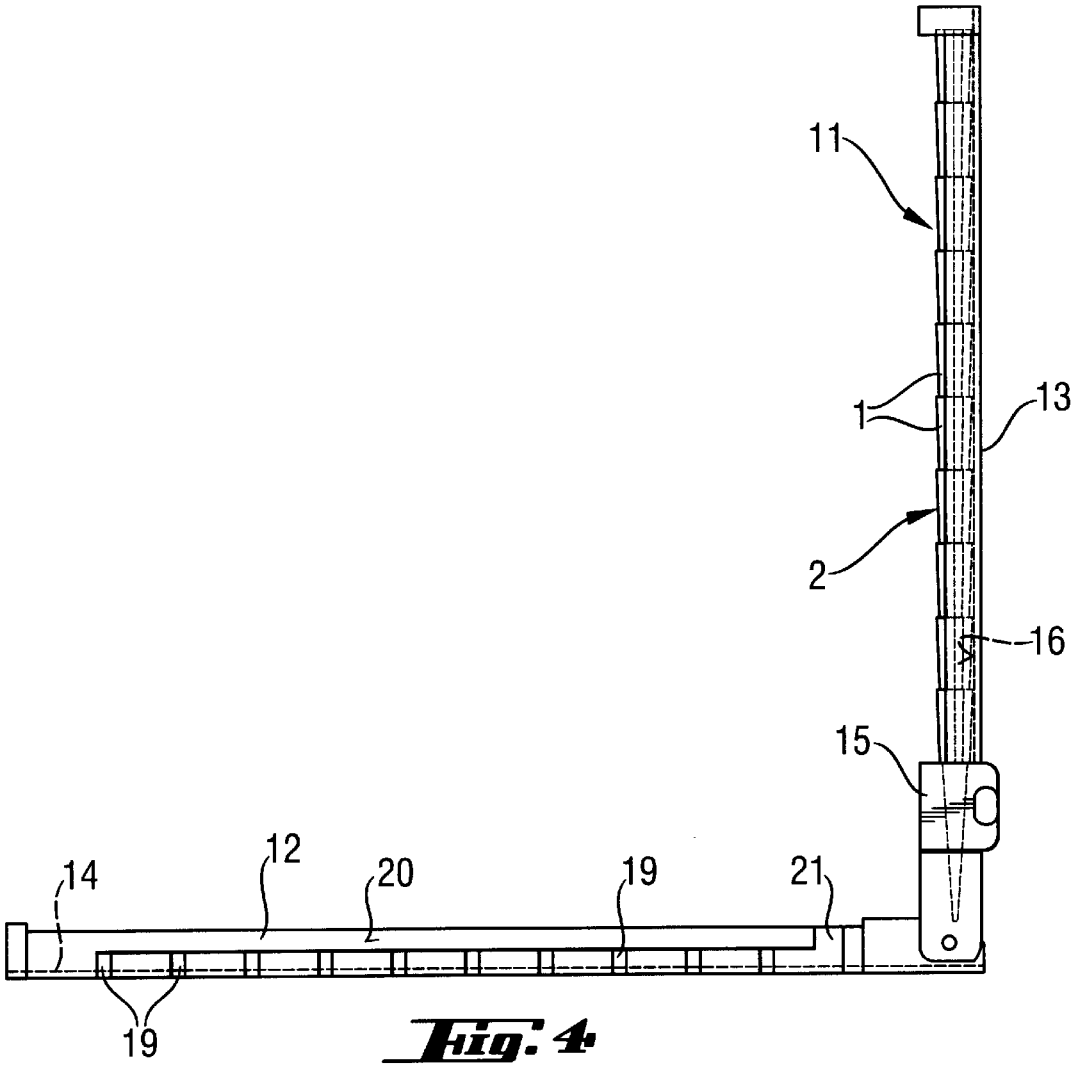
FIGS. 4 to 6 show a fourth tip kit, which serves also as a tip rack.

The pipette tips 1 illustrated in the figures comprise a conical lower part and a broader conical upper part. The outer diameter of the lower edge of the upper part is greater than the inner diameter of the upper edge. In this way, the tips can be assembled by fitting them inside each other as a column of tips 2, in which the tips do not adhere to each other.

Referring to FIG. 1, the column 2 of tips 1 have been stacked in a box 3. Along a side wall of the top of the box 3 (see the lower edge of the box 3 as it is illustrated in top plan view in FIG. 1), there is a long hole and the hole is equal in size (i.e., length and width) to one of the rows of a column of the pipette tips 1, wherein each of the columns 2 has the pipette tips 1 nestingly arranged therein. An entire row of the columns 2 of the pipette tips 1 can be removed from the box 3 one by one through the hole. The box 3 may contain one or more rows of columns 2 of tips 1. To facilitate the removal of each of the rows of the columns 2 of tips 1, the bottom 4 of the box 3 may be have a surface (not shown) which is sloped towards the hole.

The tip kit 5 shown in FIG. 2 has eight columns of tips 2. The columns of tips 2 have been joined on one side with an adhesive paper 6, which extends from the upper cone of the uppermost tips to the upper cone of the lower tips. The rows of tips 2 have a distribution corresponding to the tip interval in an eight-channel pipette used with microtitration plates. When the adhesive paper 6 is removed from the top or from the bottom, one row of tips at a time becomes available. From above, the tips may be taken for instance directly into a pipette. From below, the tips may be placed for instance in a rack, from where they can be taken into a pipette. The adhesive paper can also be removed sideways, and then one column of tips at a time becomes available.

In the pipette tip kit 7 of FIG. 3, the columns 2 of the pipette tips 1 are placed in a box 8. A groove 9, for each row of the columns 2 of the pipette tips 1, is provided at the bottom of the box 8. The box 8 is sealed with a film or cover 10 by any known means. For instance, one known way for the box 8 to be sealed by the film or cover 10 is that the film or cover may have an adhesive layer, at least along the edges, on the bottom thereof so that the edges of the film adhere to the edges of box 8. In the sealed pipette tip kit 7 as illustrated in FIG. 3, the pipette tips 1 remain as sterile as possible. In a sealed package made of a suitable material, the pipette tips 1 can also be sterilized by exposure to radiation. The film or cover 10 may be an adhesive paper to which the rows of the columns 2 of the pipette tips 1 adhere (i.e., the lateral side which is tangent to the adhesive paper adheres to the adhesive paper). In this manner, the film or cover 10, removed from the box 8 along with the rows of the columns 2 of the pipette tips 1, is useable in the same way as the pipette tip kit 5 of FIG. 2.

The cover 10 may also be removed by rolling it from one side, suitably so that the tips 1 are released row by row. A suitable tool may be used around which the cover is rolled.

Columns of tips 2 can also be removed one by one for instance from tip kits of FIGS. 1 . . . 3 and be placed in a specific dispensing rack. A dispensing rack 11. advantageously operating especially with the tip kit 5 or 7 is shown in FIGS. 4 . . . 6.

Figure 5:
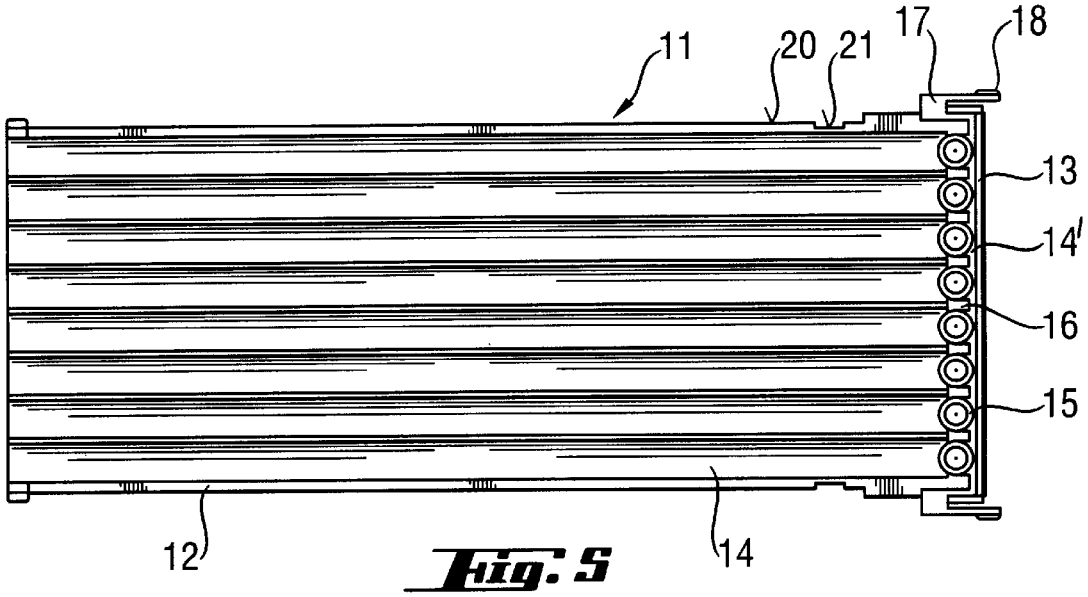

FIGS. 4 and 5 show the dispensing rack 11 in filling position. The dispensing rack has a trough-shaped frame 12 matching the shape of the tip kit and a slightly broader trough-shaped cover 13 hinged at its lower end, the cover comprising suitable locking means to interlock the frame and the cover turned into mutual contact. The frame 12 and the cover 13 have grooves 14 and 14' for the columns of tips 2. The upper ends of the frame 12 and the cover 13 are open, allowing tips to be removed from the closed rack 11.

Figure 6:
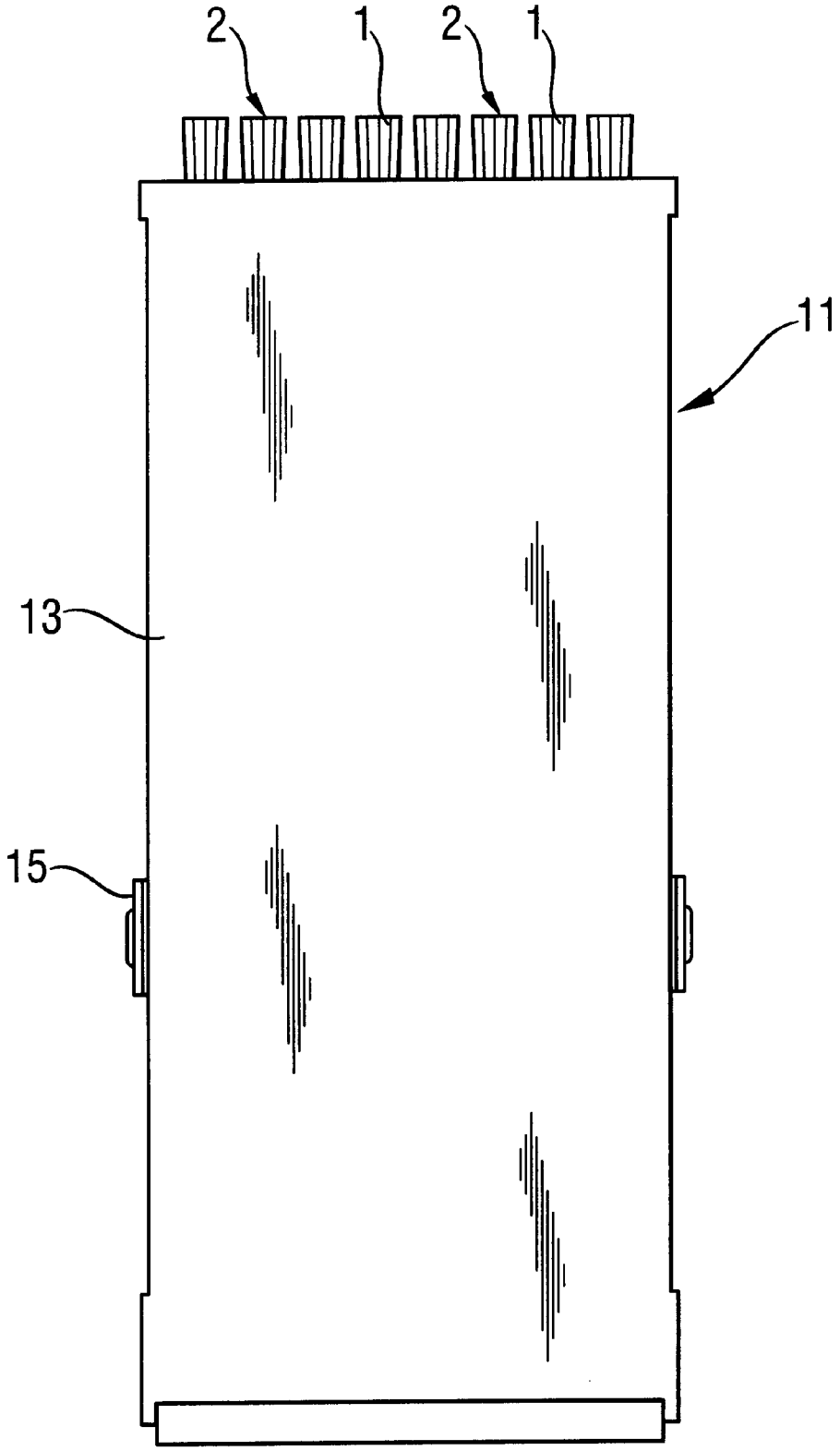

The dispensing rack 11 has a transverse movable slide 15 in the cover 13, the slide having notches 16 facing the rows of tips for each column of tips 2. The notches 16 are narrower than the upper part of the tips. The ends of the slide 15 are bent along the edge of the cover 13 and extend beyond it. In the closed dispensing rack, there is a gap between the edges of the frame 12 and the cover 13, where the slide moves. When the columns of tips 2 are placed in the dispensing rack, the slide 15 is in lower position, and then the upper parts of the lowermost tips are above the notches 16. In this manner, the columns of tips 2 can be lifted by moving the slide 15 upwards. The tips are ejected from the upper end of the rack, and can then be taken for instance into a pipette (FIG. 6).

The slide 15 has elastic gripping means 17 pressed against the edges of the dispensing rack. In this manner, the slide 15 is retained at the desired height, but is still put into motion with a small force. At the opposite end of the gripping means 17, pushers 18 are provided, which detach the gripping means from the edge of the dispensing rack when being pressed.

The edge of the dispensing rack 11 further comprises staggered notches 19, which the gripping means 17 of the slide engages. In this manner, the tips are readily pushed at regular intervals and the locking is as reliable as possible. In this dispensing rack frame 12 the staggered notches 19 are provided at its outer edge. On the upper surface of the edge of the frame 12 there is a guide 20 having a hole 21 at the hinge end, the gripping means 17 penetrating through the hole underneath the guide in the area of the staggered notches when the slide 15 is in lower position. When the slide 15 is moved upwards, the frame 12 and the cover 13 are simultaneously interlocked.

Figure 7:
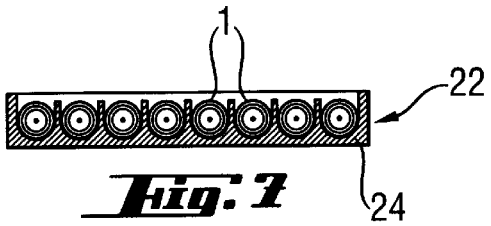
FIGS. 7 to 9 show a fifth tip kit, which serves also as a tip dispenser.
Figure 8:
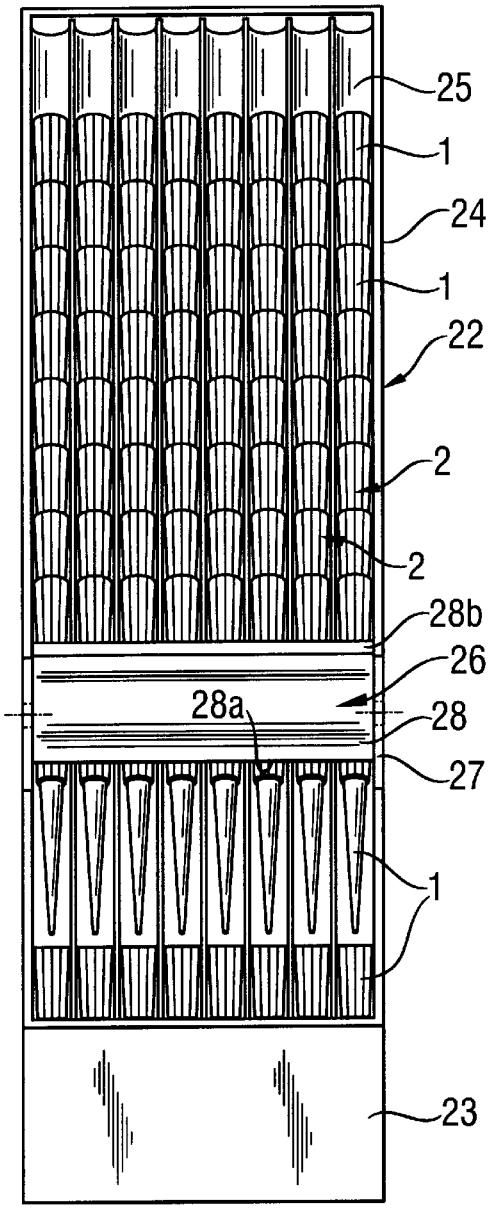
Figure 9:
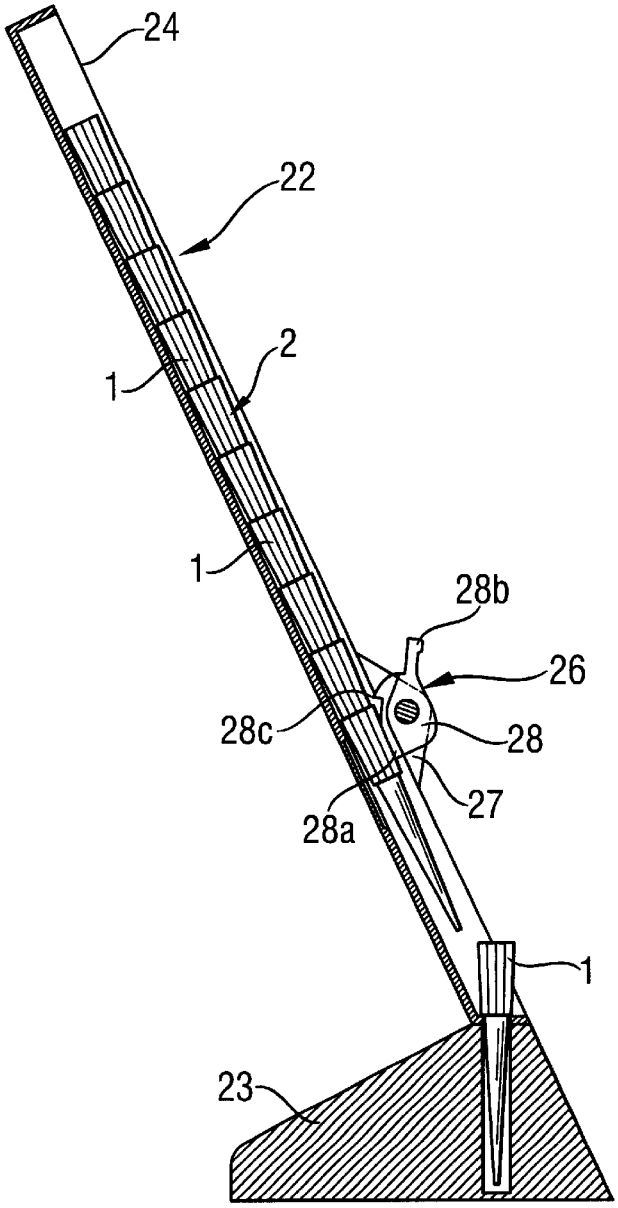

The columns of tips 2 can also be placed in a special dispensing device, from where they are distributed for instance into a tip rack standing on a table and having holes for the tips. FIGS. 7 . . . 9 show one such dispenser 22 and its use together with a tip rack 23.

The dispenser 22 has a frame 24 with longitudinal grooves 25 for the columns of tips 2. In the vicinity of the lower end of the frame 24, a dispensing means 26 is provided, supporting the columns of tips 2 so as to prevent them from dropping out of the grooves 25. However, the dispensing means 26 can serve to release tips 1 line by line, dropping them e.g. into a tip rack 23 placed below. Here the tip rack 23 has one row, but it can, of course, comprise several rows which are filled one by one.

The dispenser 22 comprises projections 27 on the sides of the frame 24 facing the groove 25, a lever 28 extending across the grooves 25 having been pivoted in the projections. The lever 28 is connected with a spring, which presses the subjacent columns of tips 2 against the lower branch 28*a* of the lever. This allows the tips 1 to be released so as to drop out of the grooves 25 when the upper branch 28*b* of the lever is pressed. The lower branch has a smooth stopper face which fits against the upper part of the tips. The upper branch 28*b* of the lever further comprises a claw 28*c*, is located above the lowermost tips when the lever 28 is in retaining position. When the lever 28 is pressed to release the tips, the claw 28*c* is pressed against the uppermost row of pipettes and thus prevents it from dropping. When the lever 28 is pressed, the columns of tips 2 drop down by one step.

Figure 11:
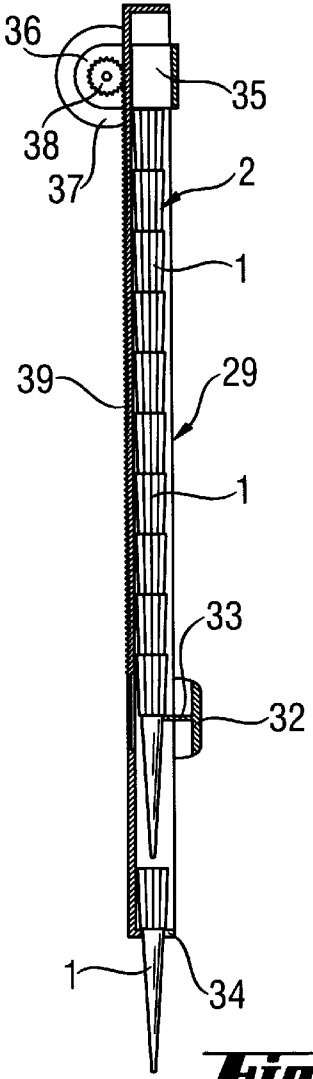
FIGS. 10 and 11 show a sixth tip kit, which serves also as a tip dispenser.
Figure 10:
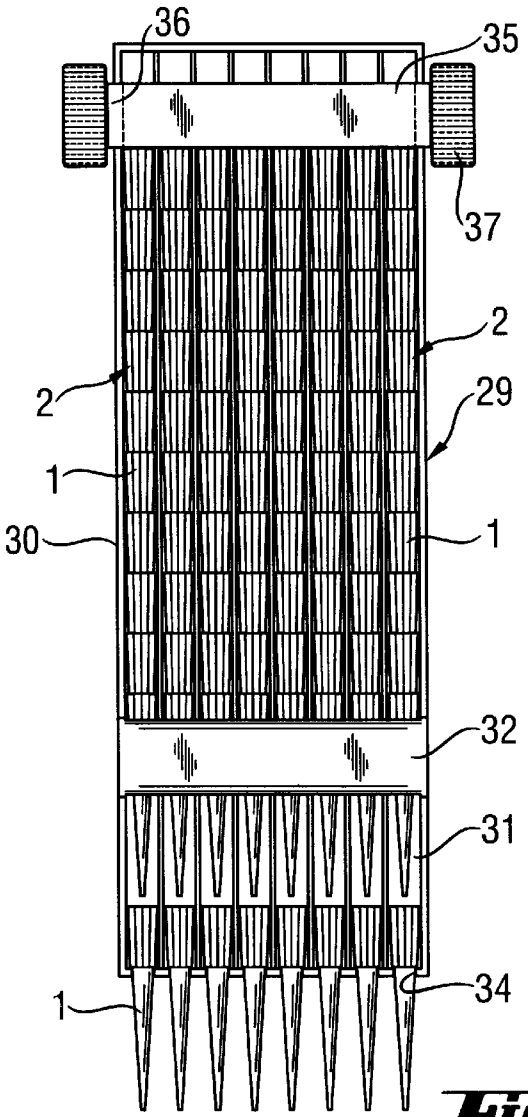

FIGS. 10 and 11 show a second dispenser 29. The dispenser has a frame 30 with longitudinal grooves 31. In the vicinity of the lower end of the frame 30, a transverse beam 32 is provided on top of the grooves 31. On the inner side of the beam 32, a flexible claw 33 protrudes in a perpendicular direction. The claw 33 extends below the lower edge of the upper cone of the lowermost tips 1 in the columns of tips 2, and then the rows of tips are retained in their grooves supported by the claw. When the columns of tips 2 are pressed from above, the claw 33 yields and lets the tips drop row by row into the lower part of the grooves 31. In their lower end, the grooves 31 have a U-shaped loop 34 with a diameter smaller than that of the lower end of the upper part of the tip. In this manner, the tips 1 are supported by these loops 34. The tips 1 supported by the loops 34 are fitted into the holes in the tip rack. The dispenser 29 is now tilted in the direction of the loops 34 so that the tips 1 are detached from these and remain in the holes of the rack.

Figure 12:
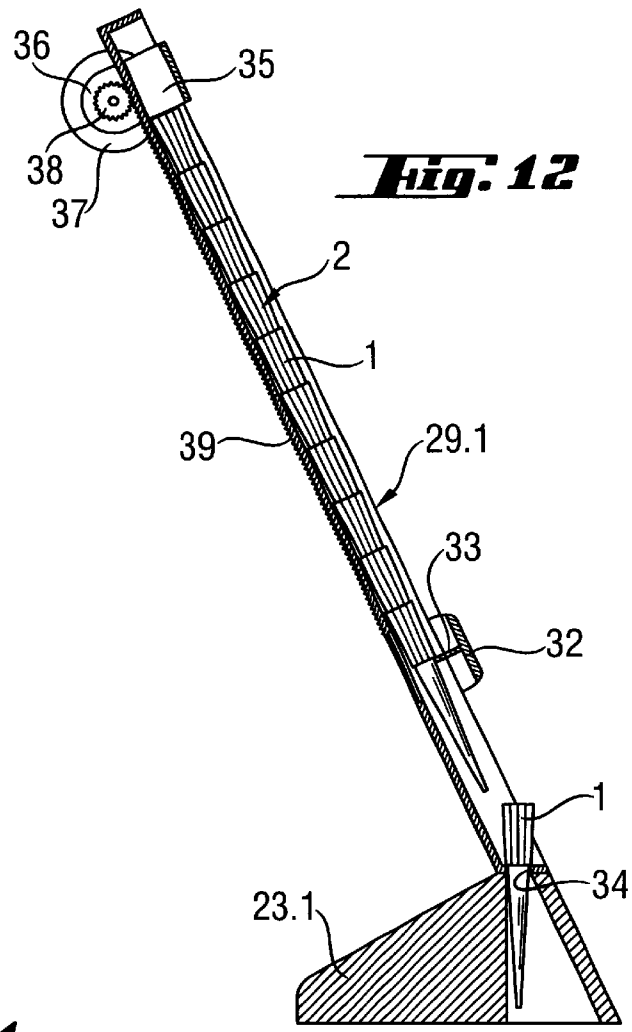
FIG. 12 shows a tip kit corresponding to FIGS. 10 and 11 attached to a tip rack.

FIG. 12 shows a dispenser 29.1 which corresponds to FIGS. 10 and 11 and which is attached in a backwards inclined position in the tip rack 23.1. There are no separate retaining loops in the lower end of the grooves, but the tips 1 drop directly into the holes in the rack 23.1, from where they can be picked into the pipette.

To press 1 the rows of tips 2 downwards, the dispenser 29 also comprises an actuator. The actuator includes a pusher 35 movable longitudinally in the frame 30 and leaning against the upper ends of the columns of tips. The pusher 35 slides supported by the edges of the frame 30, and it comprises projections 36 extending against the frame sides behind the frame. A wheel 37 has been pivoted in the part of the projections 36 located behind the frame 30, on the transverse axis of the frame, at both ends of the pusher. A smaller concentric gearwheel 38 is attached to the inside of he wheel 37. A gear rack 39 reacting to the gear wheel is provided at the edges of the frame 30 on its rear side. Thus, rotation of the wheel 37 makes the pusher 35 slide downwards while pressing the rows of tips against the lower end of the frame. The wheel 37 allows the dispensing movement to be performed with high precision so that several rows are not released in one go by mistake.

Figure 13:
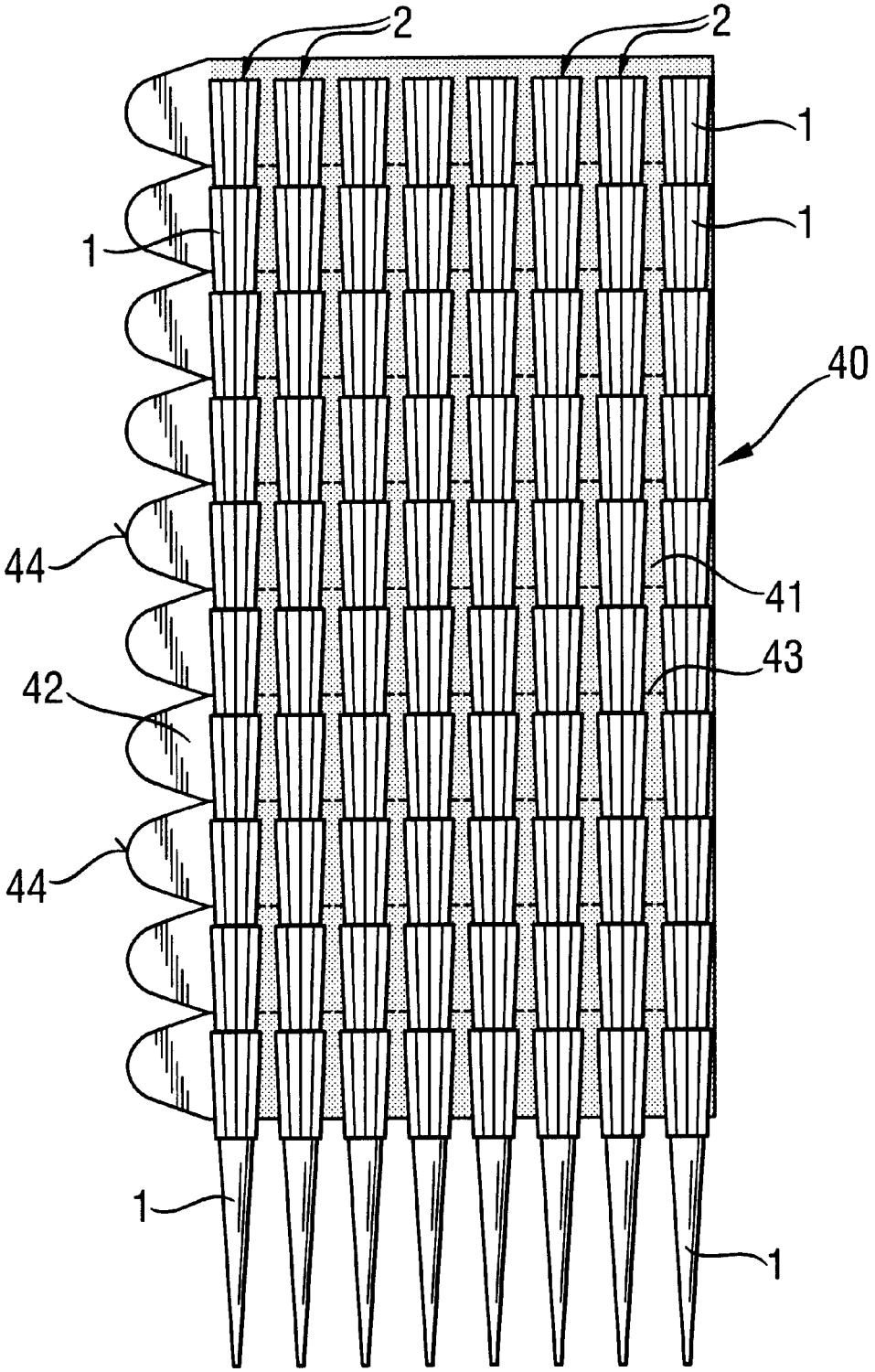
FIG. 13 shows a seventh tip kit, which may serve also as a dispensing rack.
Figure 14:
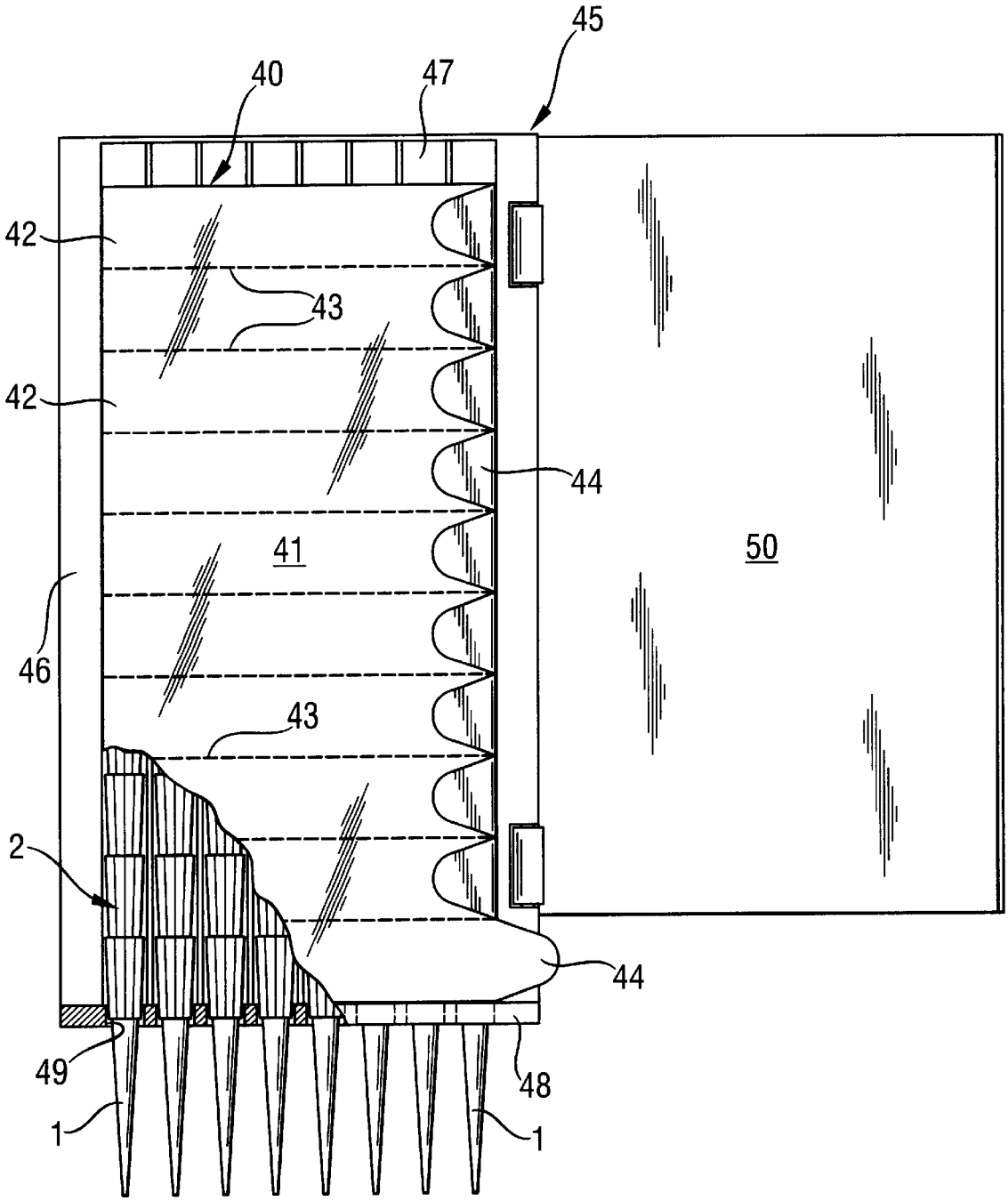
FIG. 14 shows the tip kit of FIG. 13 and a dispenser operating with it.

In the tip kit 40 illustrated in FIGS. 13 and 14, the columns of tips 2 have been removably attached to an adhesive paper 41. A number of transverse strips 42 corresponding to the number of rows of tips has been formed in the adhesive paper by mean of perforations 43. The lower edge of each strip 42 is located slightly above the lower edge of the upper part of the tips, and the upper edge slightly above the upper edge of the upper part of the tips. In addition, the other end of each strip 42 comprises a tab 44 allowing the strip 42 to be gripped to be torn off the paper 41.

When the lowermost strip 42 is totn off the adhesive paper 41, the lowermost row of tips is released and can be placed e.g. in a tip rack.

The tip kit 40 can be used for instance together with the dispenser 45 shown in FIG. 14. The dispenser 45 has a frame 46 equipped with longitudinal grooves 47 for the columns of tips 2 of the tip kit 40. The end tabs 44 of the strips 42 have been bent against the strip. At the lower end of the frame 46, a transverse wall 48 is provided, which comprises a through-hole 49 for the tips 1 at each groove 47. When the lowermost strip 42 is removed from the tip kit 40, the lowermost row of tips drops out e.g. into a tip rack placed below. At the same time the remaining rows of tips in the tip kit 40 drop down by one step.

At the other edge of the frame 46 of the dispenser 45, a cover 50 has been hinged with its lower edge at the lowermost perforation 43 of the tip kit 40. When the cover 50 is swung against the tip kit 40, the lowermost strip 42 alone will be visible. It is easily torn off along the lower edge of the cover. The lower edge may also be adequately sharpened in order to be more readily torn off.

What is claimed is:

1. A pipette tip kit for storing and dispensing a plurality of pipette tips, the pipette tip kit comprising:

at least one column of said plurality of pipette tips, wherein each pipette tip of said at least one column of said plurality of pipette tips is conical in shape so as to be nestingly arranged with respect to an adjacent pipette tip;

a paper having a support surface with an adhesive layer thereon for removably supporting a lateral surface of each pipette tip of said at least one column of said plurality of pipette tips.

2. The pipette tip kit as defined in claim 1, wherein the paper has a plurality of perforations such that each perforation of said plurality of perforations is arranged in at least one line of perforations spanning from a first side of the paper to a second side of the paper across a width of the paper.

3. The pipette tip kit as defined in claim 2, wherein said support surface is a groove protected with a cover.

4. The pipette tip kit as defined in claim 1, wherein said at least one column of said plurality of pipette tips can move on said support surface for removal of each pipette tip of said plurality of pipette tips from said pipette tip kit.

5. The pipette tip kit as defined in claim 4, wherein said at least one column of said plurality of pipette tips can move longitudinally on said support surface for removal of each pipette tip of said plurality of pipette tips from said pipette tip kit.

6. The pipette tip kit as defined in claim 2, wherein the at least one line is a plurality of lines so that a strip of the paper is formed between adjacent ones of said plurality of lines.

7. The pipette tip kit as defined in claim 6, wherein the paper is comprised of a plurality of strips which can be torn off in a strip-by-strip manner.

8. The pipette tip kit as defined in claim 7, wherein each strip of the plurality of strips includes a tab for gripping in order to tear off a bottom strip or a top strip in the strip-by-strip manner.

9. The pipette tip kit as defined in claim 8, wherein when either said bottom strip or said top strip is torn off of the paper, a bottom-most or top-most pipette tip, respectively, of the at least one column of said plurality of pipette tips is removed from the at least one column by the lateral side of the bottom-most or top-most pipette tip, respectively, being adhered to the adhesive layer of the support surface of the bottom or top strip, respectively, of the paper.

10. The pipette tip kit as defined in claim 9, wherein said adhesive layer comprises locking means configured to retain the lateral side of each pipette tip of the at least one column of the plurality of pipette tips on the support surface of the paper.

11. The pipette tip kit as defined in claim 10, wherein said locking means allows each tip of said plurality of pipette tips to be released from said at least one column of said plurality of pipette tips by pressing said at least one column of said plurality of pipette tips.

12. The pipette tip kit as defined in claim 11, further comprising an actuator for dispensing each tip of said plurality of tips.

13. The pipette tip kit as defined in claim 8, wherein either the bottom strip or the top strip and the tab associated with either the bottom strip or the top strip comprise a pipette tip removing means.

14. The pipette tip kit as defined in claim 1, wherein the at least one column of the plurality of pipette tips is several columns of said plurality of pipette tips arranged in rows so as to have a same distribution as a channel distribution of a multi-channel pipette in which each pipette tip of the several columns of pipette tips is to be used.

15. The pipette tip kit as defined in claim 1, further comprising a rack for said plurality of tips.

* * * * *